United States Patent [19]

Delbe et al.

[11] Patent Number: 4,877,229

[45] Date of Patent: Oct. 31, 1989

[54] METHOD OF EXTRACTING AND ACCELERATING FLAT OBJECTS

[75] Inventors: Emmanuel Delbe, Granges Les Valence; Francois Gillet, Parmain; Etienne Serot; Raymond Chifflet, both of Granges Les Valence; Roland Allio, La Roche De Glun; Philippe Jeantin, Valence; Gilbert Del Fabro, La Roche De Glun; Guy Forella, Saint Peray, all of France

[73] Assignee: Societe anonyme dite: Compagnie Generale D'Automatisme CGA-HBS, Paris, France

[21] Appl. No.: 213,562

[22] Filed: Jun. 30, 1988

[30] Foreign Application Priority Data

Jul. 1, 1987 [FR] France ..... 87 09312

[51] Int. Cl.[4] ..... B65H 5/10

[52] U.S. Cl. ..... 271/2; 271/265; 271/268

[58] Field of Search ..... 271/14, 2, 265, 267, 271/268; 198/464.2, 468.2; 414/751, 753

[56] References Cited

U.S. PATENT DOCUMENTS

| | | | |
|---|---|---|---|
| 2,893,732 | 7/1959 | Hanck | 271/268 |
| 2,988,355 | 6/1961 | Rabinow | 271/2 |
| 3,422,967 | 1/1969 | Aron | 414/753 |

*Primary Examiner*—Richard A. Schacher

*Attorney, Agent, or Firm*—Sughrue, Mion, Zinn, Macpeak & Seas

[57] ABSTRACT

A method of extracting and accelerating flat objects such as postal items which are presented in the outlet position of an unstacking head for use by a machine downstream therefrom, the method making use of a clamp for grasping postal items one-by-one and of various sensors (7) such as photoelectric cells, serving to indicate the presence of a postal item in the outlet position of the unstacking head, or in the field of action of the clamp, or serving to indicate that the clamp is in a waiting position or in an end-of-stroke position, the method being characterized in that it essentially comprises the following stages:

moving the clamp to a waiting position;

when the presence of a postal item is expected in the outlet position from the unstacking head, driving the carriage towards the outlet position of the unstacking head;

when the presence of the postal item is detected within the field of action of the clamp, the clamp is closed and the carriage is driven towards the downstream machine;

as soon as the presence of a postal item is no longer detected in the outlet position of the unstacking head, the clamp is unclamped, thereby releasing the postal item; and the carriage is stopped and returned to the waiting position.

7 Claims, 7 Drawing Sheets

METHOD OF EXTRACTING AND ACCELERATING FLAT OBJECTS

The present invention relates to a method of extracting and accelerating flat objects, applicable to a device for unstacking flat objects, and the invention also relates to apparatus for implementing the method.

These flat objects, may, in particular, be constituted by letters, and the unstacking device may be used for feeding a postage indexing and/or sorting machine.

BACKGROUND OF THE INVENTION

Devices for unstacking flat objects are well known. A description of one such device can be found, in particular, in French patent application No. 86 10007 filed July 9, 1986 in the name of the present Applicant. Such devices are essentially constituted by a magazine for storing a stack of postal items and an unstacking head at the end of the magazine. The magazine includes drive means for presenting the first item in the stack in a well-defined position, e.g. standing upright on an edge abutting against an abutment, and with one of the sides of the item pressing against a jogging wall. The unstacking head may be constituted by a suction cup driven with a plunging motion in order to come into contact with the first item in the stack and to grasp it by suction, and driven with a translation motion in order to take said item away from its abutment position to an outlet position where it is taken by another machine located downstream. Meanwhile, the stack is advanced in the magazine and the next postal item takes the place of the preceding item.

Given the wide variety of characteristics presented by postal items, when the unstacking head moves a first, normally-grasped item to the outlet position, it is not possible to ensure that said first item is never accompanied by a second item, at least for part of the trip. It may also happen that the item grasped by the unstacking head was not in its proper position pressed against the jogging wall, but was set back from said position so that it is the second entrained item which is in fact the leading item on arrival at the outlet position. Other cases of defective un-stacking may also be considered. Overall, they give rise to a plurality of postal items being presented together at the outlet position from the unstacking head, generally in a tiled configuration, i.e. offset linearly and overlapping only partially. If these items are then driven by a conveyor towards the downstream machine, either a reject will occur, in which case unstacking will have to be performed again at a later time, or else a sorting error will occur.

The invention seeks to reduce such cases of defective unstacking and to separate items from each other when improperly presented in this way at the outlet position, insofar as it is possible to distinguish them, i.e. whenever they are sufficiently staggered.

SUMMARY OF THE INVENTION

The invention thus provides a method of extracting and accelerating flat objects, and a device for implementing the method for placing between said unstacking outlet position and the downstream machine.

The method of the invention comprises using a clamp to grasp the postal items one by one, and essentially comprises the following steps:

moving the clamp to a waiting position;

when the presence of a postal item is expected in the outlet position from the unstacking head, driving the carriage towards the outlet position of the unstacking head;

when the presence of the postal item is detected within the field of action of the clamp, the clamp is closed and the carriage is driven towards the downstream machine;

as soon as the presence of a postal item is no longer detected in the outlet position of the unstacking head, the clamp is unclamped, thereby releasing the postal item; and the carriage is stopped and returned to the waiting position.

In the event that the presence of a postal item does not cease to be detected, an end-of-stroke detector causes the clamp to release and returns the carriage to the waiting position from which it restarts immediately in order to take a following postal item which the unstacking head has conveyed at the same time as the first.

The invention also provides a device for implementing said method and essentially comprising a clamp constituted by two articulated arms each fitted with a grasping pad and provided with the actuator means causing the two pads to move towards each other and grasp a postal item located therebetween, a moving carriage carrying said clamp, and means for moving the carriage, whereby the clamp is brought to a position in which it can grasp a postal item near the leading edge thereof, prior to moving the item and then releasing it, thereby making it available to the downstream machine.

In this way, two staggered postal items arriving together at the outlet position to which they have been brought by the unstacking head, and regardless of the order in which they arrive, are separated by the extraction clamp which takes hold of the leading one of them close to its leading edge, without taking the other one, providing they are sufficiently staggered in position.

Each of the arms preferably carries its pad at one of its ends, includes an engagement point for said actuator means at its other end, and also includes a pivot between its two ends. For example, said actuator means may be constituted by a pneumatic actuator for moving apart the two arm ends provided with engagement points, thereby moving the opposite, padcarrying ends of the two arms towards each other.

The carriage may comprise two sliders by means of which it slides on two slideways. It may then be driven by an electric motor via a toothed belt.

Various sensors such as photoelectric cells may also be provided for the purpose of detecting the presence of a postal item in the outlet position of the unstacking head, or in the field of action of the clamp, or serving to indicate that the clamp is in a waiting position or in an end-of-stroke position, etc.

BRIEF DESCRIPTION OF THE DRAWINGS

An embodiment of the invention is described by way of example with reference to the accompanying drawings, in which.

MORE DETAILED DESCRIPTION

Figure 1:
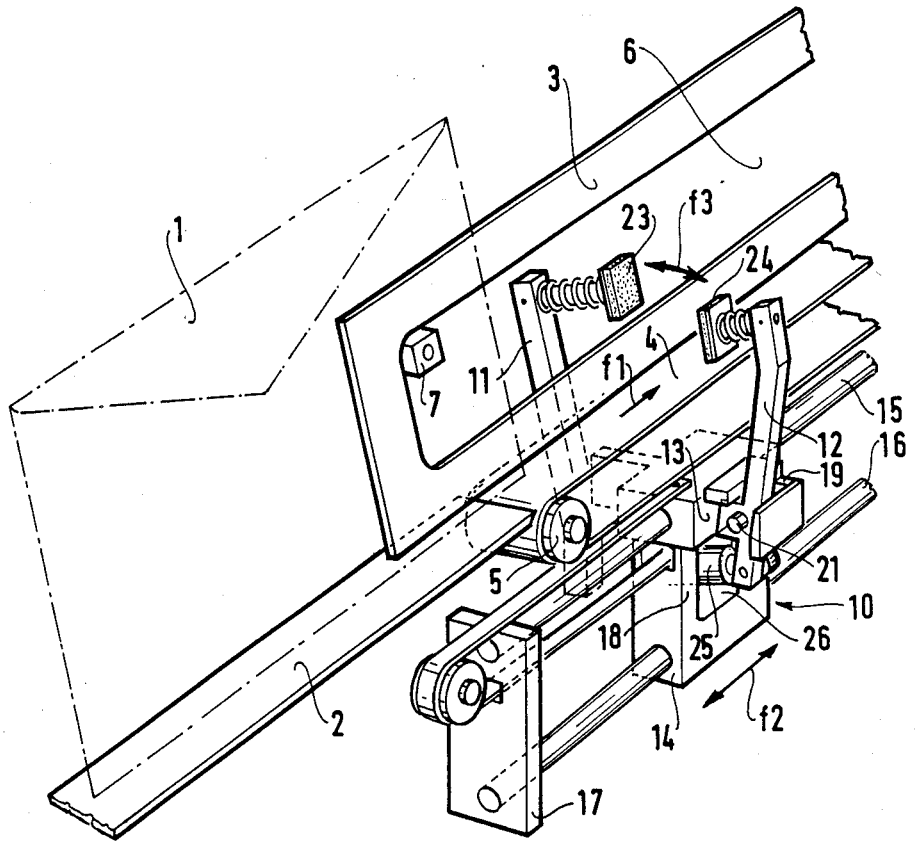
FIG. 1 is a simplified diagram of one embodiment of a device in accordance with the invention for extracting flat objects.

An embodiment of a device for implementing the method of the invention is now described with reference to FIG. 1 which shows the device in simplified manner. The FIG. 1 extractor device seeks to grasp postal items 1 presented by an unstacking head (not shown) in an outlet position 2 at the entrance to a conveyor which is essentially constituted by a conveyor wall 3 and a conveyor belt 4 running over rolls 5 and moving in the direction of arrow f1 in order to convey postal items towards a downstream machine such as a sorting machine. The conveyor wall has an oblong opening 6 through which a detector 7 such as a photoelectric cell looks in order to detect a postal item, said detector providing a signal indicative of the presence of a postal item brought to the outlet position by the unstacking head.

A carriage 10 carrying a clamp 11, 12 has the function of responding to the arrival of this signal by grasping the item being presented in order to entrain it in the direction of arrow f2 and then release it over the belt 4 so that it can then be conveyed to the downstream machine.

The carriage 10 comprises two sliders 13 and 14 sliding on two slideways 15 and 16 carried by supports 17, only one of which is shown, and it is driven by drive means which are described below. The two sliders 13 and 14 are parts of a single body 18 which also includes a cross-bar 19 carrying the jaw 11 of the clamp via a pivot 21. The other jaw 12 is similarly mounted. Each of the jaws has a pad 23 or 24. The two jaws are actuated together by a double-acting pneumatic actuator 25 disposed beneath the pivot pins 21 and passing through the body 18 via an opening 26 provided for the purpose. This actuator moves the top, pad-carrying ends of the arms towards each other as shown by arrow f3 by moving apart the bottom ends of the two jaws apart, thereby clamping the pads on a postal item presented between them in the outlet position of the unstacking head.

After the carriage 10 has moved to the right (as shown in FIG. 1), the actuator is actuated in order to open the clamp and release the moving postal item which is then conveyed by the belt 4. Thereafter the carriage returns to take the next item as soon as one is presented.

Figure 2:
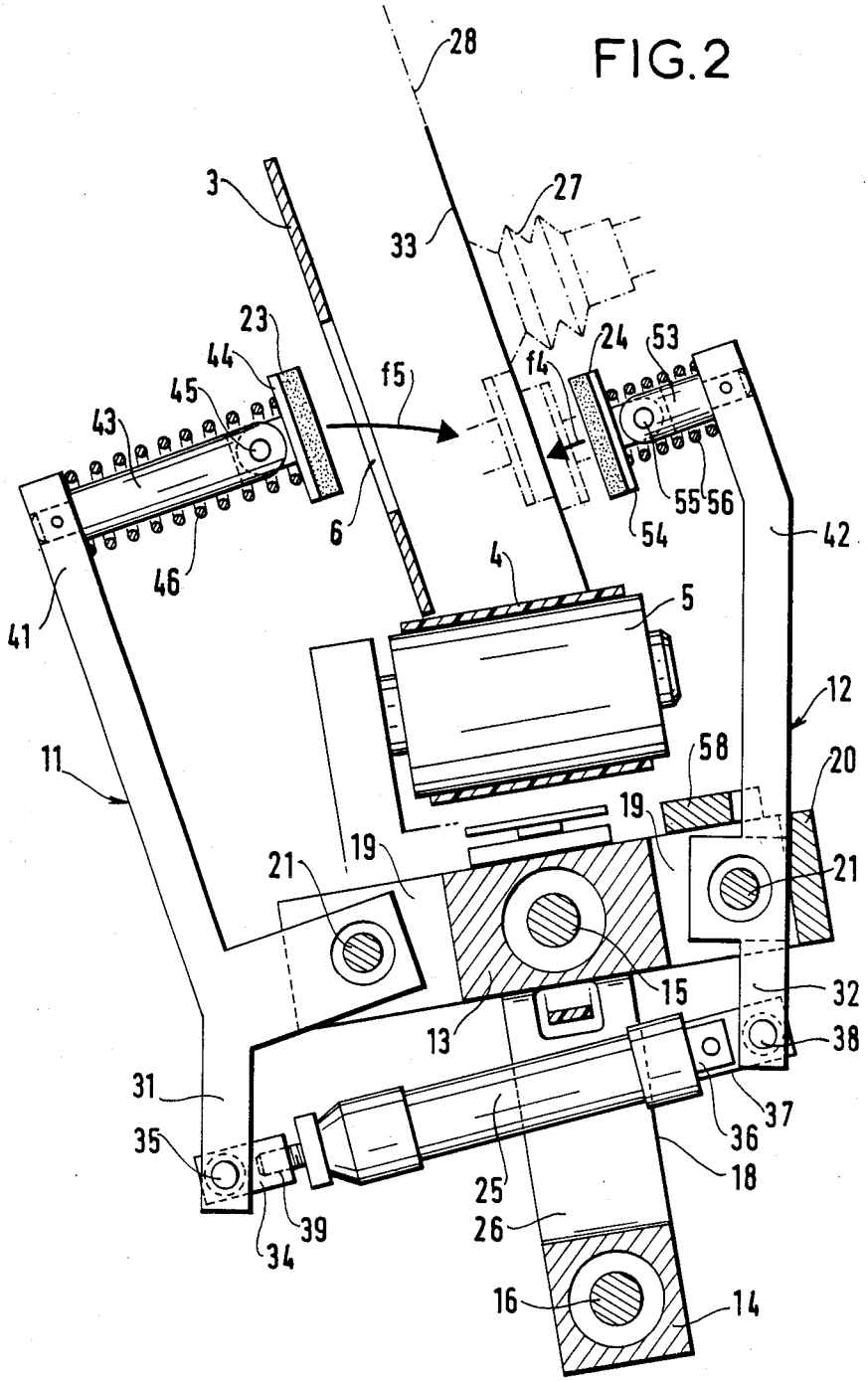
FIG. 2 is an elevation view of the clamp of the FIG. 1 extraction device.

FIG. 2 is an elevation view of the carriage 10 shown in section ahead of the jaws of the clamp jaws 11, 12 in the direction of arrow f1. This figure shows the sliders 13 and 14 of the body 18 sliding on the slideways 15 and 16, together with the jaws 11 and 12 carrying the pads 23 and 24. As can be seen, the belt 4 and its roll 5 are immediately above the carriage 10 and the entire assembly is inclined relative to the vertical so that the top surface of the belt 4 is at an angle of about 10x to the horizontal sloping towards the conveyor wall 3 which is itself also inclined relative to the vertical, and in the same direction, through an angle of about 20xC. The unstacking head which is represented by its suction cup 27 drawn in dot-dashed lines presents postal items to the extraction device in its outlet position 2 in such a manner as to cause the righthand surface of the items (as seen in FIG. 2) to coincide with a plane 28 which is parallel to the plane of the conveyor wall. The items may be of various thickness but they should never be thicker than the distance between the plane 28 and the wall 3.

The two jaws of the clamp are shown in FIG. 2 in a rest position corresponding to the actuator 25 being fully retracted and the clamp being fully open. In particular, on being pulled by the actuator 25, the jaw 12 presses against an abutment 20 which is an extension of the cross-bar 19 extending behind the arm 12. As a result, the pad 24 is located behind the plane 28. The other arm 11 is then in the position shown with its pad 23 being set back behind the conveyor wall 3. The path is thus free for the unstacking head to present a postal item.

The actuator 25 is coupled to the bottom ends of the arms 31 and 32 of the jaws 11 and 12. To this end, the shaft 39 of the actuator 25 is provided with a screw-on end fitting 34 which is coupled to the arm 31 via a pivot 35. The other end of the actuator is provided with a lug 36 which is fixed to an end fitting 37 which is coupled to the other arm 32 via a pivot 38.

It may be observed that the distance between the pivot pins 21 and 38 is considerably smaller than the distance between the pivot pins 20 and 35. The forces transmitted by the actuator to rotate the jaws are thus greater on the arm 11 than on the arm 12.

The pad 23 is mounted at the end of the arm 41 of jaw 11 by means of a rod 43 and a pad support 44. The rod 43 is fixed perpendicularly to the arm 41 by means which are not referenced. The pad support 44 is mounted on the rod 43 by a pivot pin 45 in such a manner as to enable it to pivot in the plane of the jaws 11 and 12. However, the spring 46 which is compressed around the rod 43 between the end of the arm 41 and the facing surface of the support 44 tends to maintain the pad 23 parallel to the arm 41 and perpendicular to the rod 43. The length of the rod 43 is such that the pad 23 can be moved as far as the plane 28 through the opening 6 in the conveyor wall 3 without the arm 41 hitting said wall.

The pad 24 is mounted at the end of the arm 42 by similar means: a rod 53, a support 54, a pivot pin 55, and a spring 56, and the overall effect is the same. The rod 53 is shorter than the rod 43 since there is no obstacle to be avoided.

The pads may be made of rubber, with the remainder of the device being made of metal, or optionally of plastic.

The shapes of the arms and of the rods are such that the pads are substantially parallel to each other and to the plane 28, and the lengths of the arms are such that the front faces of the pads 23 and 24 substantially coincide when they meet in the plane 28.

When the actuator is actuated in order to close the clamp, the arm 42 tilts to the left (as shown by arrow f4) and abuts against an abutment 58 fixed to the cross-bar 19. The position of this abutment is chosen so that the surface of the pad 24 is thus placed in the plane 28 in contact with the righthand surface (as seen in the figure) of a postal item 33 presented by the suction cup 27. The arm 41 simultaneously tilts towards the right (as shown by arrow f5) until the surface of the pad 24 comes into contact with the opposite surface of the postal item, after a stroke which will depend, in each case, on the thickness of the item in question. Because of the angular motion performed by the jaws 11 and 12, the surfaces of the pads tend to be no longer parallel with the plane 28, however, by virtue of their being pivotally mounted, the pads can nevertheless return to such parallel planes and bear against opposite surfaces of the postal item 33 to be grasped.

Figure 3:
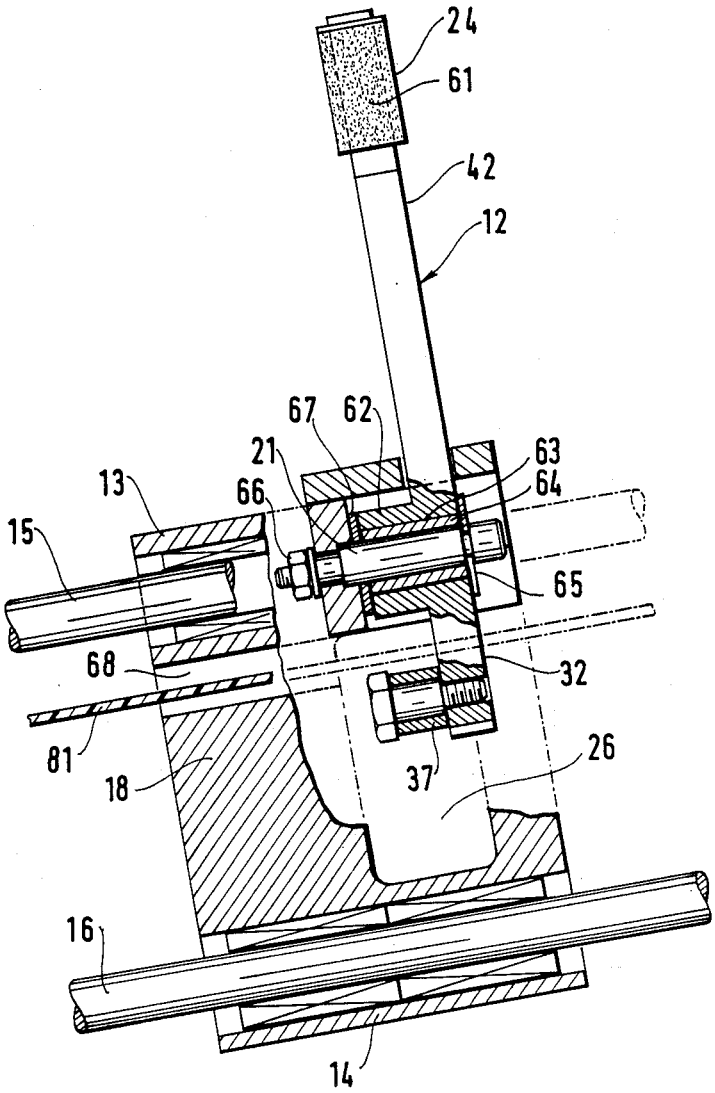
FIG. 3 is a side view of one of the arms of the FIG. 2 clamp.

FIG. 3 is a lefthand view of the jaw 2 which is shown partially in section through its pivot pins 21, with the carriage 10 also being shown partially cut-away and partially in section on the plane of the slideways 15 and 16. The figure shows the surface 61 of the pad 24, the relatively thin arm 42, its barrel 62 having a bore 63 containing a bearing 64 mounted about the pivot pin 21 and held in place by a spring clip 65. The pivot 21 is fixed to the cross-bar 19 by means of a threaded extension which has a nut 66 screwed thereon. A friction washer 67 is interposed between the barrel 62 and the cross-bar 19.

Figure 4:
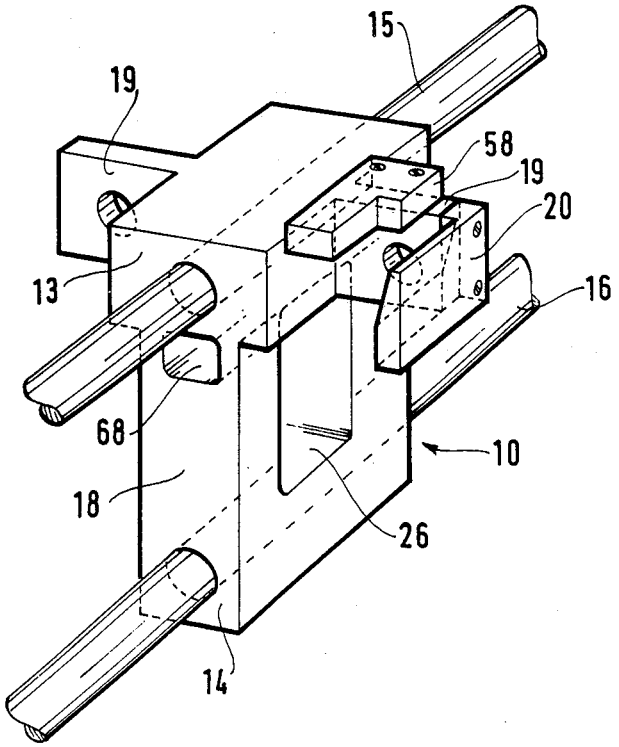
FIG. 4 is a perspective view of the FIG. 1 carriage.

FIG. 4 is a perspective view of the carriage 10 without the jaws of the clamp. Items already mentioned, particularly when describing FIG. 1, can be seen thereon. It can be seen how the opening 26 is placed within the body 18, and also that another opening 68 is provided for passing a drive belt 81 for driving the carriage 10. The cross-bar 19 and the abutments 20 and 58 can also be seen.

Figure 5:
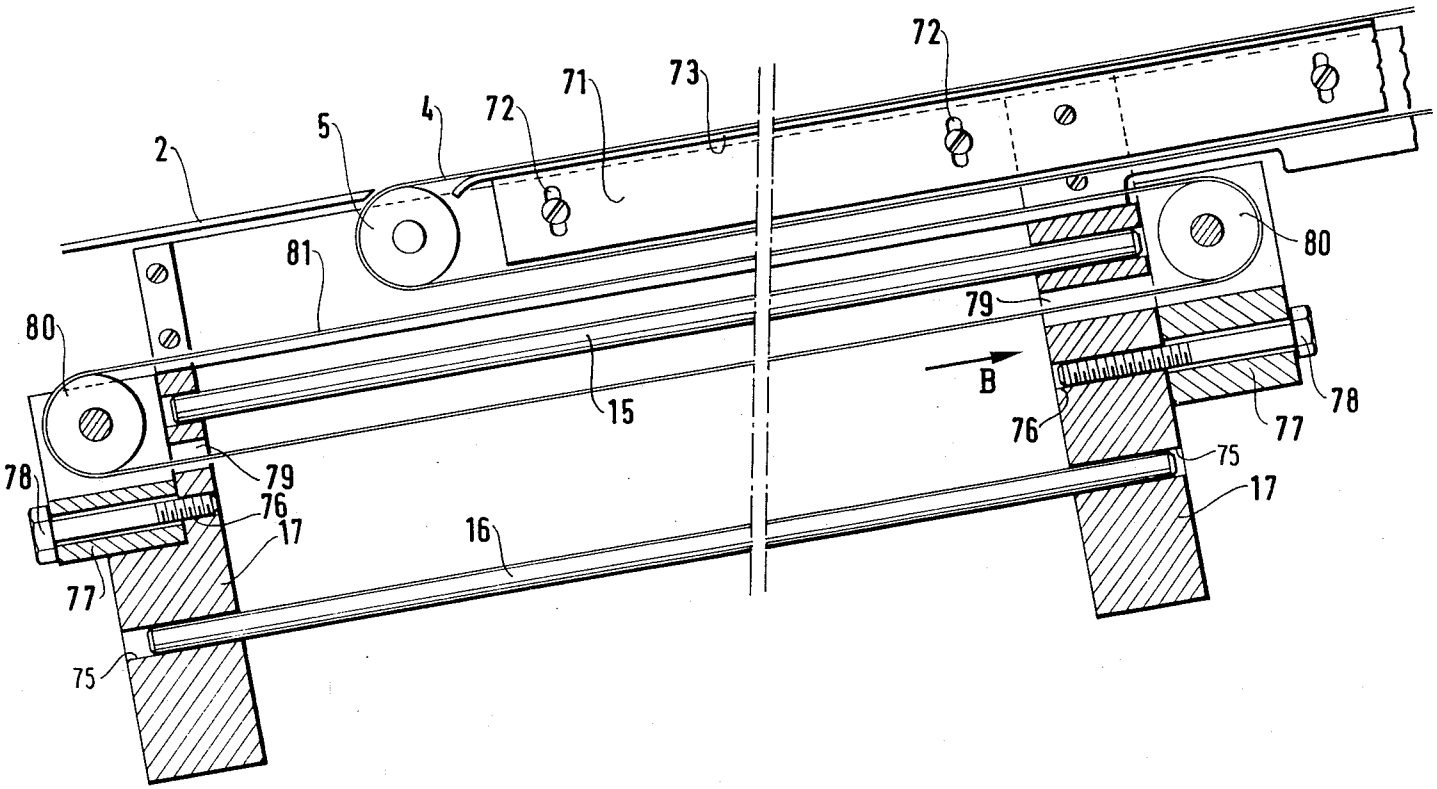
FIG. 5 is an elevation view of the guide and driving system for the FIG. 1 carriage.

FIG. 5 shows a particular implementation of means for guiding and driving the carriage 10. This figure shows the belt 4 running over rolls 5 (only one of which can be seen) and accompanied by a belt support 71 of L-shaped section and fixed to the framework of the machine by means of screws in oblong slots 72, with one of the webs 73 of the L-shape section of belt support 71 running beneath the top half of the belt 4.

FIG. 5 also shows the two slideways 15 and 16, disposed one above the other in two supports 17 which receive the ends of the slideways 15 and 16 in bores 75 designed, for example, to be a tight fit around the slideways. In addition, each of the supports 17 is provided with a tapped bore 76 for fixing a wheel mount 77 by means of a screw 78, for example, together with an orifice 79 for passing the belt 81. As can be seen, the wheels 80 carried by the mounts 76 are positioned so that the centers of the wheels lie in the vicinity of the axis of slideway 15 and so that the belt 81 for driving the carriage 10 runs over the slideway 15 in one direction and returns beneath it in the opposite direction.

Figure 6:
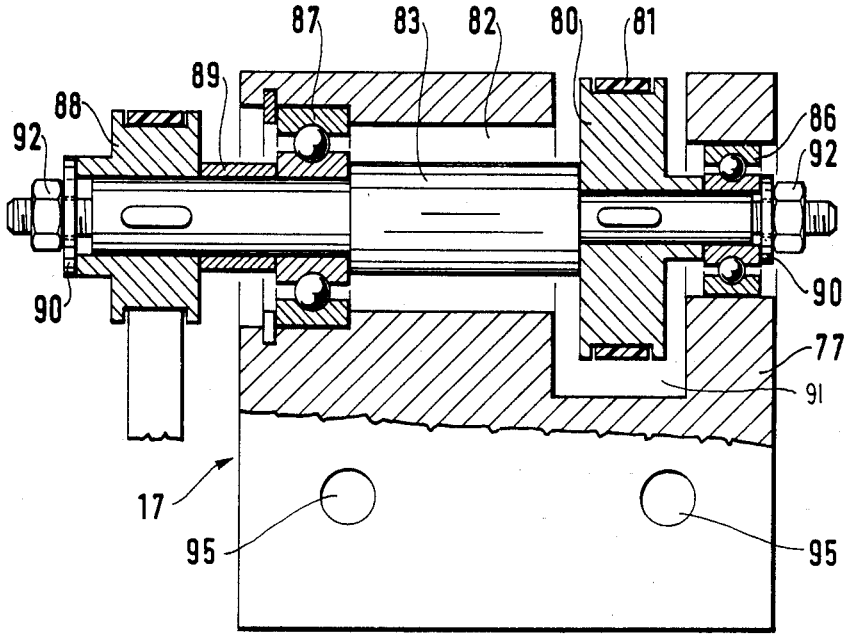
FIG. 6 is a fragmentary section view through the drive and coupling wheels of the FIG. 5 system.

FIG. 6 shows one of the supports 17 in greater detail and in partial section as seen along arrow B of FIG. 5 and shown on a scale which is larger than of the preceding drawings. It can be seen that the wheel mount 77 is a part including a notch 91 for receiving the wheel 80 and which is pierced by a stepped bore 82 for receiving the shaft 83 of the wheel 80 via ball bearings 86 and 87 which are received in said bore, together with two bores 95 for fixing to the corresponding support 17 via screws 78 (see FIG. 5). The shaft 83 of one of the wheels 80 extends outside its mount 77 and carries a drive pulley 88 which is separated from ball bearing 87 by a spacer 89. The assembly is held in place by nuts 92 bearing against washers 90 at each end of the shaft 83. An electric motor (not shown) may be mounted, for example, on the righthand support 17 and be used to drive the wheel 80 and thus the belt 81 by means of a belt (not shown) coupled to the drive pulley 88, thereby displacing the carriage 10 to the right or to the left depending on its direction of rotation.

The extraction method of the invention implementing the extractor device shown in FIGS. 1 to 6 is now described with reference to FIG. 7. In order to control the operation of the motor driving the belt 81 and the actuator 25, the method requires a control member such as a microprocessor, and also a number of position sensors which may be constituted by appropriately located photoelectric cells. Thus, the microprocessor receives the following input signals from sensors appropriately disposed on the above-described structure, e.g. from sensor 7 shown in FIG. 1:

G=carriage in the extreme right position (towards the downstream machine);

H=carriage in the waiting position;

E 1.2.=an item is ready in the outlet position; and

F=an item is present ready for grasping by the clamp.

Figure 7:
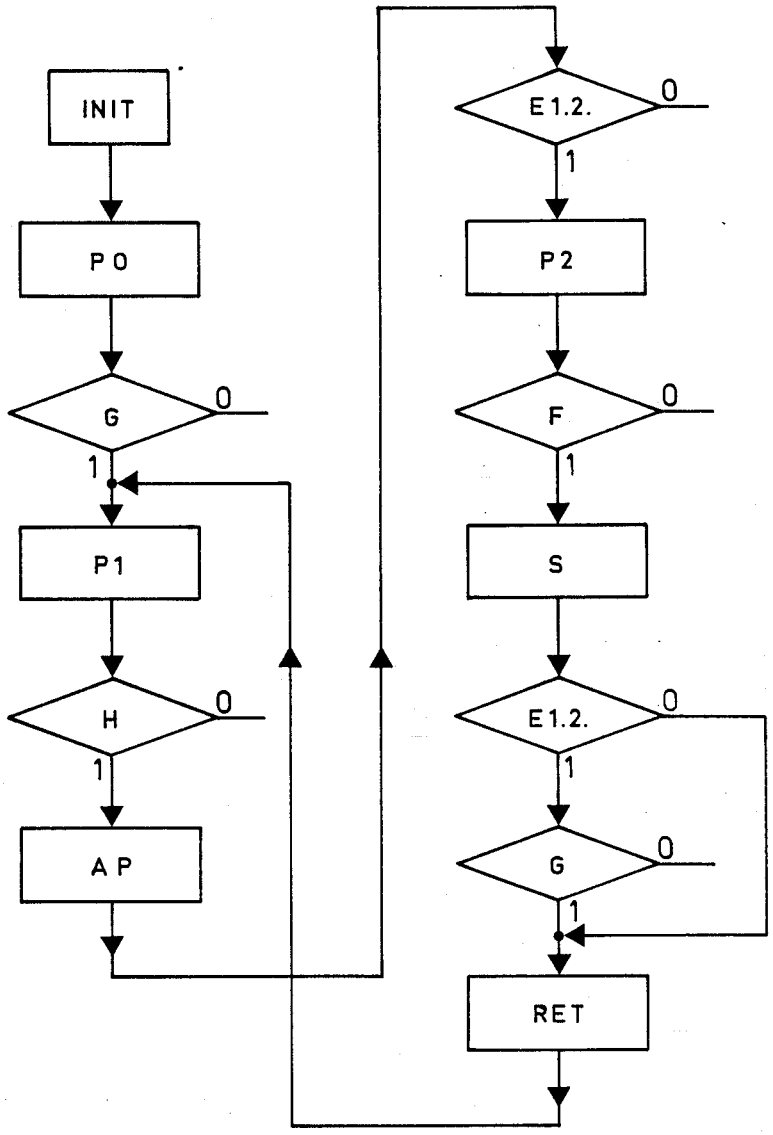
FIG. 7 is a flow chart showing one implementation of the control method in accordance with the invention for the purpose of controlling the device shown in the preceding figures.

In general, the processor returns periodically in the process illustrated by FIG. 7 to the point at which it abandoned the process during a preceding period (stages marked by rectangles) and it interrogates an input in order to determine whether it is time to move onto the next stage.

When the machine is switched on, the processor always starts from a beginning-of-cycle position INIT. The method implemented by the processor then includes the following stages:

P0=drive the carriage to the right (FIGS. 1 and 5);

P1=when the signal G is present, indicating that the carriage has reached its extreme right position, stage P0 is replaced by stage P1 during which the carriage is driven to the left towards the outlet position from the unstacking head;

AP=when the carriage arrives in an intermediate position which corresponds to the position reached by the postal items presented by the unstacking head, the signal H is delivered and the microprocessor moves onto stage AP during which no instructions are given;

P2=as soon as a postal item is supplied by the unstacking head, the signal E 1.2. is present and the microprocessor moves onto stage P2 in which the carriage is again moved to the left;

S=however, as soon as the corresponding sensor indicates that a postal item is level with the clamp, by providing signal F, the microprocessor moves onto stage S during which the clamp is closed by the action of actuator 25 (FIG. 1) while the carriage 10 is simultaneously driven to the right (i.e. towards the downstream machine);

RET=this stage is not a genuine stage since it consists simply in returning to stage P1 once the presence of a postal item in the outlet position from the unstacking head ceases to be indicated by the corresponding sensor (E 1.2.=0), or as soon as the carriage reaches it extreme right position (G=0); however, it corresponds to the clamp being opened in order to release the postal item it has grasped while the carriage is still moving, such that the item is already moving prior to being released onto the belt 4; thereafter the rightwards movement is stopped and the carriage returns to the waiting position, with these operations taking place either as soon as the postal item whose presence in the outlet position of the unstacking head which triggered the performance of a cycle has been completely extracted from said position by the clamp (and was in this position on its own), or else as soon as the clamp has reached the end of its stroke (which means that although the grasped postal item has indeed been extracted, there still remains a postal item in the outlet position of the unstacking head, i.e. there were originally two or more such items present).

We claim:

1. A method of extracting and accelerating flat postal items presented in an outlet position of an unstacking head for use by a machine downstream therefrom, said method making use of a clamp for grasping said flat postal items one-by-one and of various sensors to indicate the presence of a postal item in the outlet position of the unstacking head, or in the field of action of the clamp, and to indicate that the clamp is in a waiting position or in an end-of-stroke position, said method comprising the following steps:

moving said clamp to a waiting position;

when the presence of a postal item is expected in the outlet position from the unstacking head, driving the carriage towards the outlet position of the unstacking head;

detecting the presence of the postal item within the field of action of the clamp, closing said clamp and driving said carriage towards the downstream machine;

detecting the lack of continued presence of a postal item in the outlet position of the unstacking head, unclamping said clamp, thereby releasing the postal item; and stopping the carriage and returning said carriage to the waiting position.

2. A method according to claim 1, further comprising the step of continuing to detect the presence of a postal item in the outlet position of the unstacking head, detecting an end-of-stroke of the carriage and actuating the the clamp to release the postal item, and returning the carriage to its waiting position, and immediately restarting a cycle in order to take the next postal item, if unstacked, by the unstacking head simultaneously with the first postal item.

3. A device for extracting and accelerating flat postal items for use with a device for unstacking flat postal items constituted by a storage magazine for storing the objects in a stack, an unstacking head at the end of the magazine, and drive means for presenting the first item in the stack in a well-defined abutment position, and the unstacking head grasping the first item from the stack to drive it away from its abutment position up to an outlet position, said extractor device comprising:

a clamp constituted by two hinged jaws each fitted with a grasping pad, actuator means for causing the two pads to move towards each other to grasp a postal item located therebetween, a moving carriage carrying said clamp, and means for moving the carriage to bring the clamp to a first position for grasping a postal item near a leading edge thereof, prior to moving the item and to a second position making it available to a downstream machine by releasing said item.

4. An extractor device according to claim 3, wherein each of the jaws carries said pad at one end of a first arm, and each of said jaws includes an engagement point for said actuator means at an end of a second arm, and said device also includes pivot means between said two arms.

5. An extractor device according to claim 4, wherein said actuator means are constituted by an pneumatic actuator for moving apart the ends of the two second arms which are provided with engagement points, thereby moving towards each other the opposite ends of the two pad-carrying first arms.

6. An extractor device according to claim 3, wherein the carriage comprises two sliders and two slideways for said sliders by means of which it slides on said two slideways.

7. An extractor device according to claim 6, wherein an electric motor driven toothed belt engages said carriage to drive said carriage.

* * * * *